US005938371A

United States Patent [19]

Gustin et al.

[11] Patent Number: 5,938,371

[45] Date of Patent: Aug. 17, 1999

[54] FUMES ABATEMENT SYSTEM FOR AN ASPHALT PAVING MACHINE

[75] Inventors: Craig R. Gustin, Andover; Keith R. Schmidt, Anoka, both of Minn.

[73] Assignee: Caterpillar Paving Products, Minneapolis, Minn.

[21] Appl. No.: 08/931,724

[22] Filed: Sep. 16, 1997

[51] Int. Cl.[6] ..... E01C 19/00; E01C 19/12; E01C 19/18

[52] U.S. Cl. ..... 404/108; 404/83; 404/101

[58] Field of Search ..... 404/77, 79, 83, 404/92, 95, 101, 108, 110, 75

[56] References Cited

U.S. PATENT DOCUMENTS

| | | | |
|---|---|---|---|
| 3,804,079 | 4/1974 | Schrader | 126/343.5 A |
| 4,011,023 | 3/1977 | Cutler | 404/91 |
| 4,012,160 | 3/1977 | Parker | 404/84 |
| 4,033,328 | 7/1977 | Lohman et al. | 126/343.5 A |
| 4,182,631 | 1/1980 | Mendenhall | 106/281 R |
| 4,619,550 | 10/1986 | Jeppson | 404/80 |
| 4,964,752 | 10/1990 | Astrope et al. | 404/92 |
| 5,139,362 | 8/1992 | Richter et al. | 404/95 |
| 5,443,325 | 8/1995 | Simonelli et al. | 404/75 |

*Primary Examiner*—Thomas B. Will
*Assistant Examiner*—Gary S. Hartmann
*Attorney, Agent, or Firm*—Lawhorn, Simpson & Polsley

[57] ABSTRACT

A fumes abatement system for an asphalt paving machine is disclosed for dispelling noxious fumes that are emitted from asphalt in the hopper of and from behind the paving machine during paving operations. The fumes abatement system utilizes existing plate walls of the feeder tunnel and superstructure to eliminate additional parts and for increased durability. A high capacity blower and a tall exhaust stack are used to disperse the fumes well above the operators of the machine.

5 Claims, 2 Drawing Sheets

FUMES ABATEMENT SYSTEM FOR AN ASPHALT PAVING MACHINE

TECHNICAL FIELD

The present invention relates generally to asphalt paving machines and the like and, more particularly, to a fumes abatement system for dispersing noxious fumes emanating from the asphalt paving material away from the machine operator.

BACKGROUND ART

It has been common practice to employ asphalt paving machines or like apparatus for the purpose of laying asphalt paving material for forming hard surface roads. Typically, these asphalt paving machines are self-propelled and include an operator station for permitting an on-board operator to ensure that the asphalt material is properly placed and that the resulting road surface is properly laid. The asphalt material is leveled and compacted by a screed located at the rear of the asphalt paving machine. A separate station may be provided for a screed operator to control the paving operation of the screed independently so as to enable the machine operator to exercise more control over the paving machine. The asphalt paving material commonly used for the construction of hard surface paved roads is comprised of a mixture of an aggregate, such as sand, gravel, or rock material and an asphalt binding material. Such asphalt binding material may be relatively fluid when heated to a higher temperature than common ambient conditions, but will harden to a relatively solid material when allowed to cool to typical ambient conditions. A road surface constructed of such asphalt material is typically fairly resistant to wear and tear from typical motor vehicles and is popular because of its ease and speed of application.

One noticeable disadvantage inherent with the use of asphalt is that the petroleum distillates in the asphalt tend to emit substantial amounts of hydrocarbon and other foul smelling fumes when the asphalt is heated. These fumes can include nitrogen, sulfur, benzene, and other hydrocarbon materials, many of which are capable causing harm to plants and animals as well as to the operators of the asphalt paving machine and other construction personnel who typically spend a great of deal of time in the immediate vicinity of the paving machine.

In U.S. Pat. No. 5,443,325 issued Aug. 22, 1995 to Michael T. Simonelli et al., entitled "ASPHALT FUME REDUCTION SYSTEM," a fumes processor is disclosed where fumes are burned in an engine of the paver or otherwise processed to remove or reduce noxious components of such fumes. The system disclosed therein uses thin ducting to transport fumes from a hood to an air cleaner, which is then communicated with the engine or to the exhaust pipe of the engine. While such fumes abatement system has been fairly successful in reducing the fumes emitted from the asphalt, several disadvantages have been noted. One such disadvantage is that specialized ducting must be designed, constructed and installed around and routed through the components of the paving machine, undesirably increasing the cost of the paving machine. Furthermore, such duct work is typically constructed of relatively thin and light weight sheet metal, plastic, fabric, fibrous or other like materials which are susceptible to damage and also typically includes a number of joints and connections, both of which tend to contribute to reduced efficiency in, as well as to leakage of fumes from, the fumes abatement system. Additionally, such fumes abatement systems often increase the incidental maintenance costs of the paving machine due to the fact they may need to be removed and reinstalled during routine maintenance of other components of the machine. In addition, the burning of fumes in the engine has proved to be injurious to the engine by fouling components and by shortening its useful life before overhaul and/or other maintenance.

Accordingly, it would be highly advantageous to provide a fumes abatement system which is relatively immune to damage and is non-injurious to other components of the paver, while providing a relatively high degree of efficiency in minimizing the amount of fumes affecting the operator of the machine, yet be relatively inexpensive to build and maintain.

DISCLOSURE OF THE INVENTION

In accordance with one aspect of the present invention, there is provided a fumes abatement system for an asphalt paving machine. The paving machine has a front end and a back end with an asphalt receiving hopper carried at the front end and having a rear wall. The paver also includes a superstructure upon which an engine for propelling the machine and an operator station are carried. A feeder tunnel extends from the rear wall of the hopper under the superstructure to the back end of the machine. An asphalt feeder extends rearward from the hopper through the feeder tunnel to the back end of the machine for depositing such asphalt at the back end of the machine onto the road surface to be paved with asphalt. The fumes abatement system includes an air ducting system having a longitudinally extending duct portion and a vertically extending duct portion. The longitudinally extending duct portion is disposed along and above the feeder tunnel with a front end adjacent the rear wall of the hopper and a rear end having a first inlet adjacent the back end of the machine. The vertical duct portion extends through the superstructure adjacent the rear wall of the hopper and has an upper end with a second air inlet opening into the hopper and a lower end connected and communicating with the longitudinally extending portion. An air evacuation system is carried on the superstructure and has an air plenum connected to and communicating with the longitudinally extending duct portion. An elongated air exhaust stack extends from the plenum through the superstructure to a height above the operator station. A motor-driven blower mounted within the plenum is used for drawing air in through the first and second inlets and for exhausting such air through the exhaust stack.

BEST MODE FOR CARRYING OUT THE INVENTION

Figure 1:
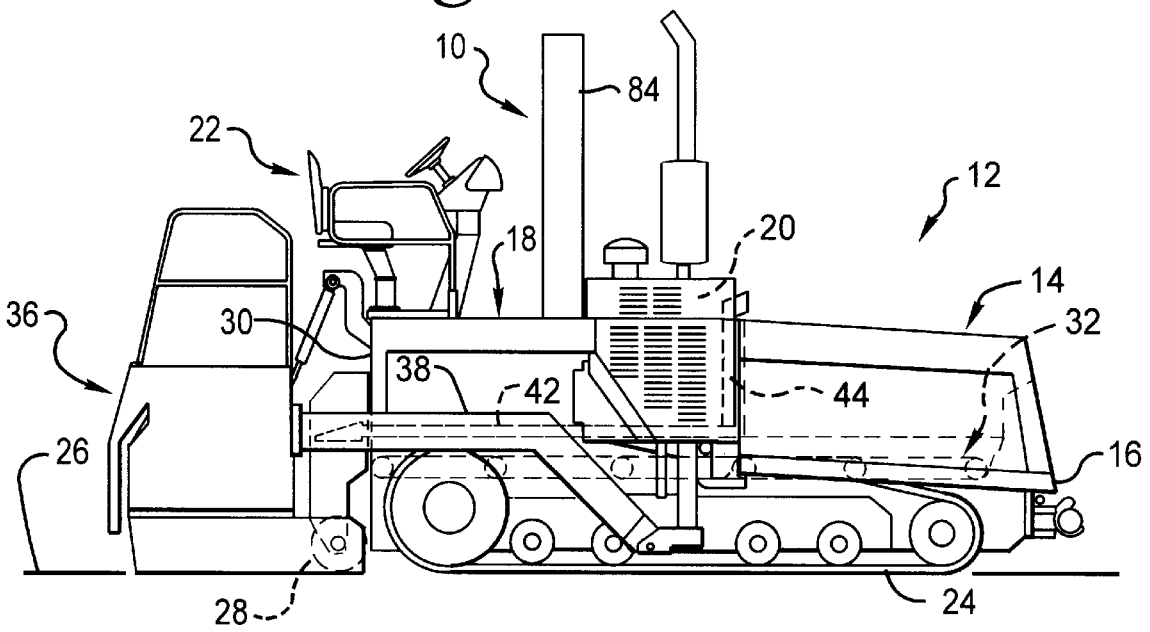
FIG. 1 is a generally schematic side elevational view of an asphalt paver machine incorporating a fumes abatement system embodying the principles of the present invention.
Figure 2:
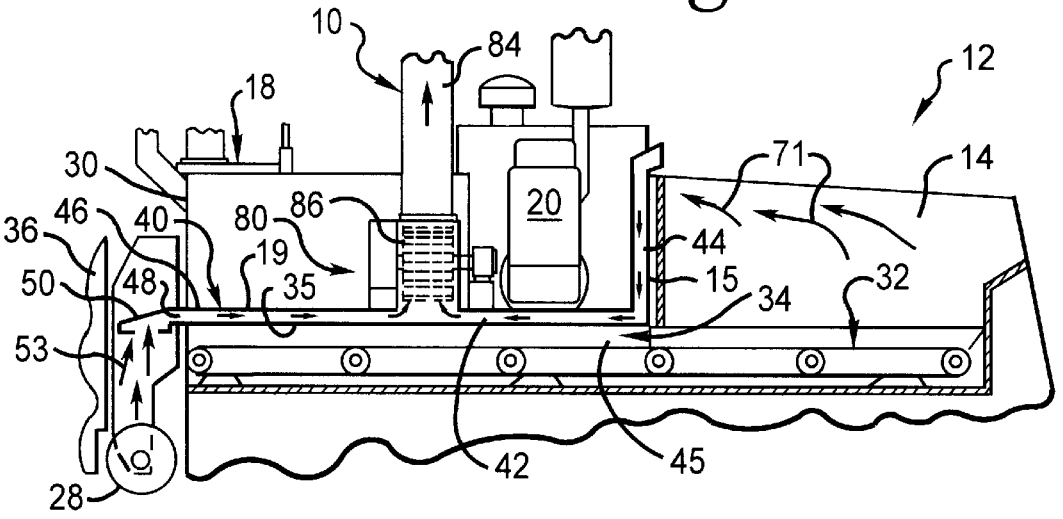
FIG. 2 is a fragmentary schematic cross-sectional side view to better illustrate the components of the fumes abatement system.
Figure 3:
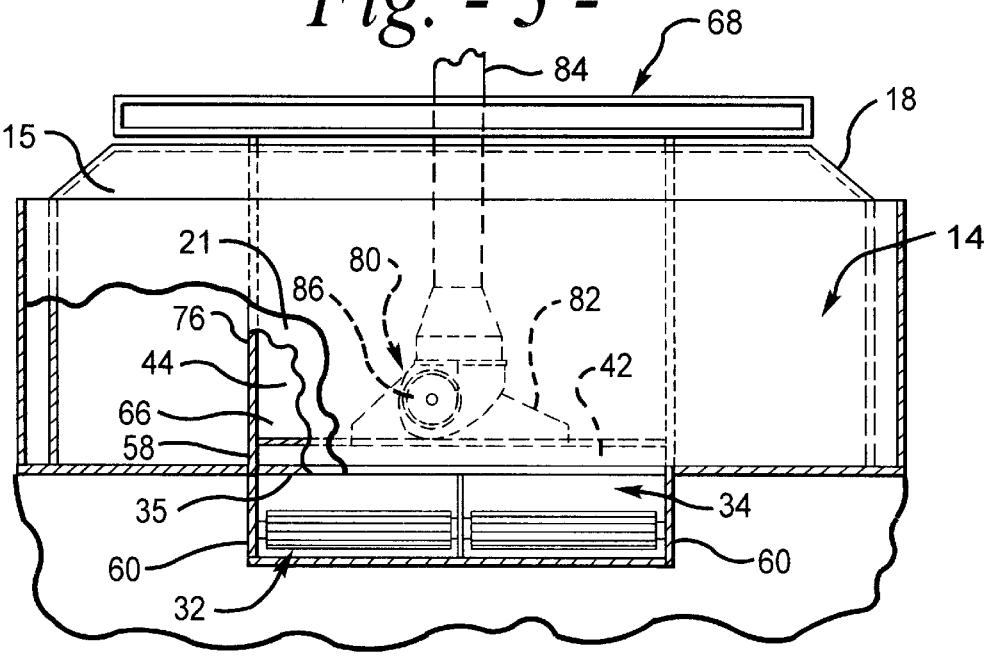
FIG. 3 is a fragmentary schematic front view of the hopper of the asphalt paver.
Figure 4:
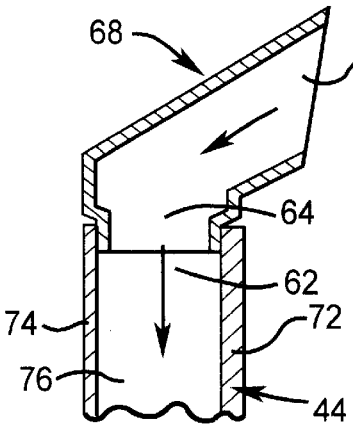
FIG. 4 is an enlarged cross-sectional view of a first air inlet and hood of the fumes abatement system.

Referring more particularly to the drawings, a fumes abatement system is generally depicted at 10 in FIGS. 1 and 2 for an asphalt paving machine 12. The paving machine 12 has an asphalt receiving hopper 14 carried at its front end 16 for receiving asphalt material from a dump truck, for example. The hopper 14 has a laterally disposed rear wall 15. The paving machine 12 includes a superstructure 18 upon which an engine 20 and an operator's station 22 are carried. The superstructure 18 has a bottom floor plate 19 and front wall plate 21. The bottom floor plate 19 and front wall plate 21 are typically constructed from rolled steel plate, having a plate thickness of about ¼ of an inch or greater. The engine 20, located within the superstructure 18 and preferably a diesel type engine, drives either wheels or a pair of tracks 24, as shown in this instance, for propelling the machine 12 over a surface, such as a roadbed 26 on which the asphalt is to be deposited.

A rotating auger 28 is located at the back end 30 of the machine 12 to distribute the asphalt material toward the sides of the paving machine 12. An asphalt feeder 32, in the form of a slat type conveyor for example, extends from the hopper 14 to the back end 30 of the machine 12 for depositing the asphalt material on the roadbed 26 to be paved with asphalt. The asphalt feeder conveyor 32 extends rearwardly from the hopper 14 through a feeder tunnel 34 located under the superstructure 18 to the back end of the paving machine 12 and deposits asphalt on the roadbed 26 to be paved at a location ahead of the auger 28. The top of the tunnel 34 is closed by a top cover plate 35, which is disposed a predetermined distance below the bottom floor plate 19 of the superstructure 18. The top cover plate 35 is constructed of rolled steel plate having a thickness of about ¼ of an inch or greater.

A screed 36 is disposed behind the auger 28 for further distributing and leveling the asphalt material distributed by the auger. The screed 36 is pulled by a pair of tow arms, one of which is shown at 38, which are secured to a respective one of the sides of the paving machine 12 so as to permit the screed to "float", thereby providing a smoothly paved surface despite irregularities in the roadbed 26. To this point, the paving machine 12 and associated apparatus described are well known in the art and is not intended to be limiting, but rather illustrative of apparatus and applications in which the present invention is preferably employed.

Figure 5:
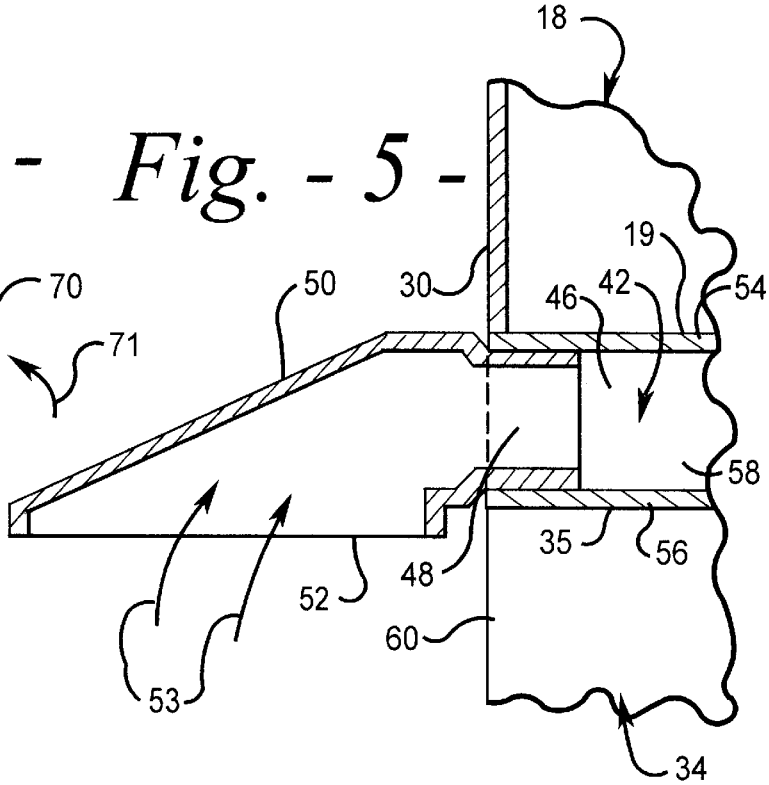
FIG. 5 is an enlarged cross-sectional view of a second air inlet and hood of the fumes abatement system.

In accordance to a preferred embodiment of the invention, the fumes abatement system 10 for an asphalt paving machine is provided with an air ducting system 40 having a longitudinally extending duct portion 42 and a vertically extending duct portion 44. The longitudinally extending duct portion 42 is disposed along and above the feeder tunnel 34 with a forward end 45 adjacent the rear wall 15 of the hopper 14 and a rearward end 46 having a first air inlet 48 adjacent the back end 30 of the machine 12. As best shown in FIG. 5, a rearward duct hood 50 is mounted on the first inlet 48 and has an opening 52 directed downward for admitting a flow of fumes 53 from asphalt deposited at the back end of the paving machine 12 into the ducting system 40. Rather than using thin sheet metal ducting material (typically having a thickness of about 1/16 of an inch or less) or other non-rigid material, to construct the longitudinal duct portion 42, the duct portion 42 has a top panel 54 formed by the bottom floor plate 19 of the superstructure 18 and a bottom panel 56 formed by the top cover plate 35 of the feeder tunnel. The opposite side panels 58 are preferably formed by extending the respective side walls 60 of the tunnel 34, which are also constructed from rolled steel plate. As a consequence, the entirety of the longitudinally extending duct portion 42 is constructed from steel plate, which is much thicker than typical sheet metal material used for ducting, and thus less susceptible to damage. More particularly, existing components or modifications of existing components of the machine are used to construct the ductwork The vertical duct portion 44 is disposed adjacent and extends along the rear wall 15 of the hopper 14. Such vertical duct portion 44 has an upper end 62, which is provided with a second air inlet 64 opening into the hopper 14 and a lower end 66 connected to and communicating with the longitudinally extending duct portion 42. A forward duct hood 68 is preferably mounted on the second inlet 64. The forward duct hood 68 is located above the upper end of the rear wall 15 of and has on opening 70 directed toward the hopper 14 for admitting a flow of fumes 71 from asphalt contained within the hopper 14 into the ducting system 40. The vertically extending duct portion 44 also has a forward panel 72, a rearward panel 74 spaced from the forward panel, and a pair of opposite laterally spaced side panels 76. The forward panel 72 is advantageously formed by the front wall plate 21 of the superstructure 18.

The fumes abatement system 10 also includes an air evacuation system 80 carried on the superstructure. The air evacuation system 80 preferably has an air plenum 82 connected to and communicating with the longitudinally extending duct portion 42, an elongated air exhaust stack 84 extending from the plenum through the superstructure to a height above the operator's station, and a motor driven blower 86 mounted within the plenum for drawing air in through the first and second air inlets 48,64 and exhausting the air through the exhaust stack 84. The blower 86 is preferably of a squirrel cage type, by may be of any other type which is well known in the art, and may be belt driven from the engine 20 or driven by a separate electric or hydraulic motor, not shown.

INDUSTRIAL APPLICABILITY

The construction of a fumes abatement system 10 in accordance with the present invention offers several advantages over prior known systems. As indicated earlier, the top and bottom panels 54,56 of the longitudinally extending duct portion 42 are advantageously formed by the bottom floor plate 19 of the superstructure 18 and the top cover plate 35 of the tunnel 34, respectively. Likewise, the forward panel 72 of the vertically extending duct portion 44 is advantageously formed by the front wall plate 21 of the superstructure 18. As these structures are all constructed from structural materials, such as rolled steel plate, rather than relatively thin sheet metal, the duct portions 42, 44 are much stronger and less susceptible to damage than ducts constructed from such thin sheet metal. As existing structures are used to form the ducts, fewer parts are needed and the costs of manufacturing and installing such parts are eliminated.

In use, the fumes abatement system 10 has a blower 86 of sufficiently high capacity to move a high volume of air at relatively high velocity through the air ducting system 40 and out the exhaust stack 84. As a consequence, a vacuum effect is generated at the first and second air inlets 48,64 to suction in the noxious fumes from the asphalt in either the hopper 14 or at the back end 30 of the machine 12. The exhaust stack 84 is constructed to terminate at a height above the operators stationed in the operator's station 22 or on the screed 36 and the fumes are expelled out of the stack 84 at a sufficient velocity to disperse the fumes at an elevation well above the operators and those working in the immediate vicinity of the paving machine 12. Thus, the workers are relieved of noxious fumes without the need for expensive and difficult to maintain components of some prior devices and without any fouling or causing other injury to the engine 20.

Other aspects, objects and advantages of the present invention can be obtained from a study of the drawings, the disclosure and the appended claims.

We claim:

1. A fumes abatement system for an asphalt paving machine, said machine having a front end and a back end, an asphalt receiving hopper carried at the front end of said machine and having a rear wall, a superstructure upon which an engine for propelling the machine and an operator's station are carried, a feeder tunnel extending from the rear wall of the hopper under said superstructure to the back end of the machine, an asphalt feeder extending rearward from the hopper through said feeder tunnel to the back end of the machine for depositing asphalt at the back end of the machine onto the road surface to be paved with asphalt, said fumes abatement system comprising:

an air ducting system having a longitudinally extending duct portion and a vertically extending duct portion, said longitudinally extending duct portion being disposed along and above said feeder tunnel with a front end adjacent said rear wall of said hopper and a rear end having a first air inlet adjacent said back end of the machine, said vertical duct portion extending through said superstructure adjacent said rear wall of said hopper and having an upper end with a second air inlet opening into said hopper and a lower end connected to and communicating with said longitudinally extending duct portion; and an air evacuation system carried on said superstructure and having an air plenum connected to and communicating with said longitudinally extending duct portion, an elongated air exhaust stack extending from said plenum through said superstructure to a height above said operator's station, and a motor driven blower mounted within said plenum for drawing air in through said first and second air inlets and exhausting said air through said exhaust stack.

2. The fumes abatement system of claim 1 wherein said feeder tunnel has a top cover plate and said superstructure has a bottom floor plate spaced a predetermined distance above said top cover plate and wherein said longitudinally extending duct portion has top and bottom sides respectively formed by said bottom floor plate and said top cover plate.

3. The fumes abatement system of claim 2 wherein said superstructure includes a front wall plate and said vertically extending duct portion has a forward side and a rearward side, said forward side being formed by said front wall plate of said superstructure.

4. The fumes abatement system of claim 3 wherein said air ducting system includes forward duct hood mounting on said second inlet, said forward hood being located above said rear wall of and having on opening directed toward said hopper for admitting a flow of fumes from asphalt contained within said hopper into said ducting system.

5. The fumes abatement system of claim 4 wherein said air ducting system includes a rearward duct hood mounted on said first inlet, said rearward hood having an opening directed downward for admitting a flow of fumes from asphalt deposited at the back end of the paving machine into said ducting system.

* * * * *